US008720095B2

(12) United States Patent
Wright

(10) Patent No.: US 8,720,095 B2
(45) Date of Patent: May 13, 2014

(54) FIREARM MAGAZINE

(76) Inventor: Perry Wright, La Mesa, CA (US)

( * ) Notice: Subject to any disclaimer, the term of this patent is extended or adjusted under 35 U.S.C. 154(b) by 151 days.

(21) Appl. No.: 13/159,601

(22) Filed: Jun. 14, 2011

(65) Prior Publication Data

US 2011/0308128 A1 Dec. 22, 2011

Related U.S. Application Data

(60) Provisional application No. 61/356,376, filed on Jun. 18, 2010.

(51) Int. Cl.
*F41A 9/61* (2006.01)
*F41A 9/65* (2006.01)

(52) U.S. Cl.
CPC ..... *F41A 9/65* (2013.01)
USPC ..... 42/50

(58) Field of Classification Search
USPC ..... 42/49.01, 50
See application file for complete search history.

(56) References Cited

U.S. PATENT DOCUMENTS 1,351,370 A * 8/1920 Chase ..... 42/7
1,797,951 A 3/1931 Gaidos
2,137,491 A * 11/1938 Huff ..... 42/90
2,783,570 A * 3/1957 Kunz ..... 42/87
2,862,324 A 12/1958 Ball
4,514,922 A * 5/1985 Farrar et al. ..... 42/50
4,516,346 A 5/1985 Farrar et al.
4,614,052 A * 9/1986 Brown et al. ..... 42/87
5,099,595 A * 3/1992 Chesnut et al. ..... 42/50
5,375,359 A * 12/1994 Chesnut et al. ..... 42/50
7,200,964 B2 4/2007 Gates
7,237,354 B1 * 7/2007 Conner ..... 42/50
7,497,044 B2 3/2009 Cammenga et al.
8,234,810 B2 * 8/2012 Lee, III ..... 42/87

* cited by examiner

*Primary Examiner* — Samir Abdosh
(74) *Attorney, Agent, or Firm* — Mark Wisnosky

(57) ABSTRACT

A firearm magazine that is designed to make the loading of cartridges easier and faster, while being constructed of fewer parts for higher reliability and with no protruding elements that preclude its use in pre-existing firearms. In one embodiment, a box-type magazine is provided with an internal spring and a follower. The body of the magazine and the follower are specially constructed to facilitate manual loading. The body of the magazine incorporates a slot extending along the path of the follower. The follower is fabricated with a concave opening on a lateral surface that can be manually accessed through the slot in the magazine body, thereby allowing a user to depress the follower against the pressure of the internal spring using a finger or thumb while the cartridges are easily loaded at the top of the magazine body.

3 Claims, 4 Drawing Sheets

FIREARM MAGAZINE

CROSS-REFERENCE TO RELATED APPLICATIONS

This application claims priority to Provisional application 61/356,376 filed 16 Jun. 2010 which is incorporated herein by reference in its entirety.

BACKGROUND OF THE INVENTION

1. Technical Field

The present invention relates to a magazine for a firearm having features that facilitate the loading of cartridges into the magazine.

2. Related Background Art

Traditional firearm magazines require manual loading of the cartridges through an upper opening in the magazine while overcoming the progressively increasing resistance of a compressed magazine spring as the magazine is filled. As it is loaded, each cartridge is generally pressed against a previously loaded cartridge, thus requiring considerable finger strength and dexterity. Many firearm users find the prerequisite finger strength and dexterity needed to manually load a firearm magazine difficult, particularly under adverse tactical environmental conditions. The resistance of the magazine spring slows the speed at which the magazine can be loaded, as well as tiring individuals required to load multiple magazines.

Many attempts have been made to provide magazines that are designed to facilitate loading or to provide separate devices that facilitate the loading of magazines. Separate devices are undesirable because of the inconvenience of having to carry them separately and the difficulties presented if they are lost or misplaced. On the other hand, the new magazine designs typically require complex additional mechanical elements that protrude from the magazine and preclude their use in firearms that are not specifically designed to accommodate them, and which constitute a reliability risk from mechanical damage or the intrusion of dirt or debris.

Consequently, it is desirable to provide a firearm magazine that is designed to make the loading of cartridges easier, faster and less tedious, while being constructed of fewer parts for higher reliability with no protruding elements that preclude its use in pre-existing firearms.

DISCLOSURE OF THE INVENTION

A firearm magazine is provided with a simple and reliable self-contained structure that allows easier and faster loading of cartridges without the need for separate tools or devices. In one embodiment, a box-type magazine is provided with an internal spring and a follower. The body of the magazine and the follower are specially constructed to facilitate manual loading. The body of the magazine incorporates a slot extending along the path of the follower and having a width of from ½ inch to approximately 2 inches, depending on the size of the cartridges that are to be stored within the magazine. The follower is constructed to incorporate a concave opening on a lateral surface that can be manually accessed through the slot in the magazine housing, thereby allowing a user to depress the follower against the pressure of the magazine spring using a finger or thumb while the cartridges are easily loaded at the top of the magazine body. No protruding elements exist, allowing the improved magazine design to be used with existing firearms without any alteration to the firearm.

DETAILED DESCRIPTION

Figure 1:
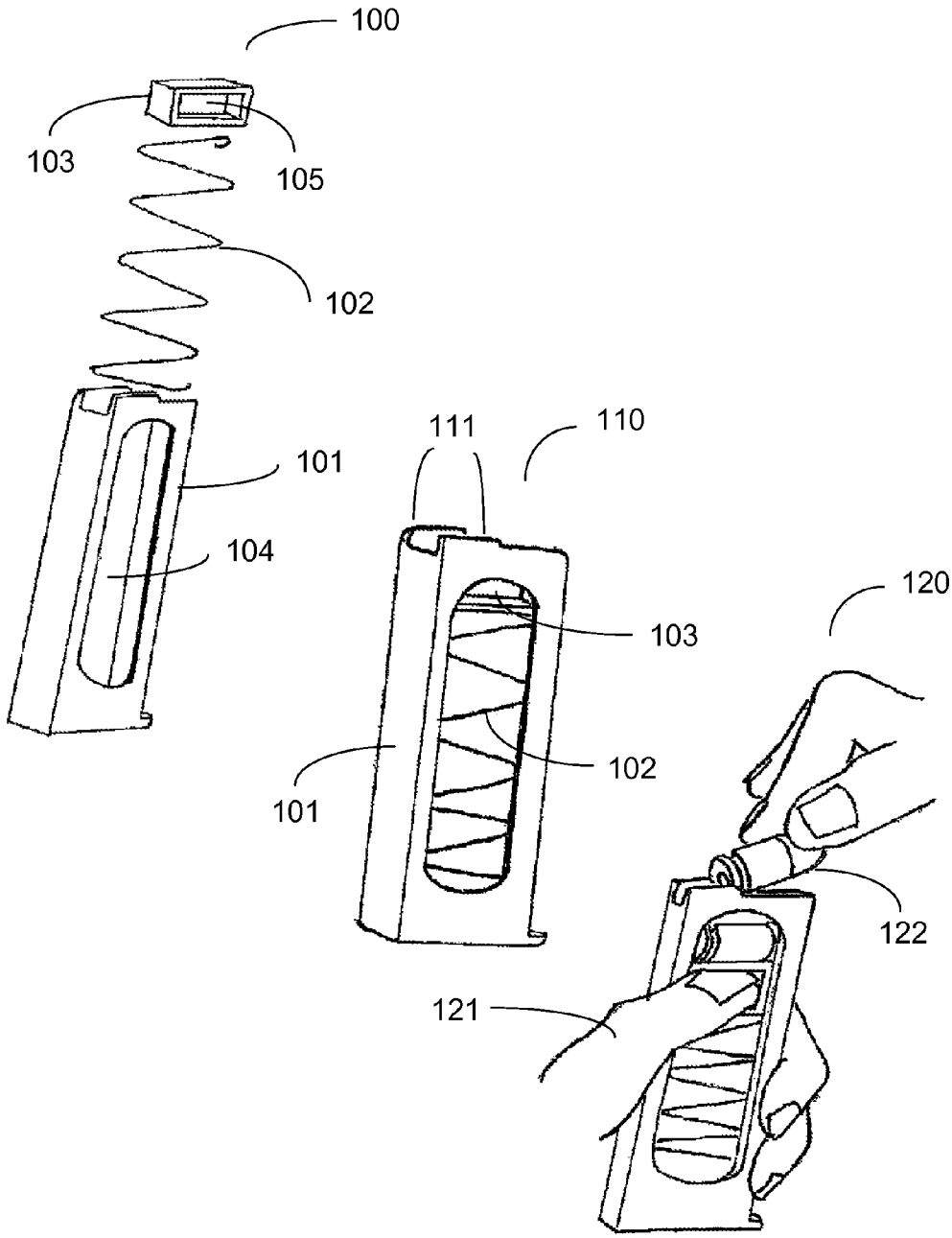
FIG. 1 shows the elements of the invention and illustrates its use.

The instant invention will be described using a specific embodiment as shown in the figures. This embodiment is exemplary and nonlimiting, as it is readily apparent to one skilled in the art that numerous variants exist, depending on the particular firearm for which the magazine is intended and the particular manufacturing processes available to fabricate the magazine. FIG. 1 is a sketch showing the elements of the invention and illustrating its use. An exploded view 100 shows a standard box-type magazine body 101, and internal spring 102 and a follower 103. Magazine body 101 can be fabricated using, for example, metal stamping, and includes a slot 104 extending along the path of follower 103. Follower 103 can likewise be fabricated using a stamped and bent metal plate, a metal casting or, alternatively, an injection molded plastic and includes concave opening 105 on the lateral surface adjacent to the slot 104 in magazine body 101. The assembled magazine 110 illustrates the use of bent tabs 111 at the top of the magazine body to constrain the uppermost travel of the follower 103 when it is installed within the magazine body 101 and in contact with the partially compressed internal spring 102. Loading the magazine 120 is simply accomplished by inserting a finger or thumb 121 into the opening 105 of the follower 103 through the slot 104 in the magazine body 101 and manually compressing the internal spring 102 while inserting a cartridge 122 at the top of the magazine. The uppermost loaded cartridge is constrained by the pressure exerted by the compressed internal spring 102 through the follower and previously loaded cartridges and by the bent tabs 111 at the top of the magazine body. The slot 104 in the magazine body 101 is also useful for the easy removal of collected dirt and debris that might otherwise impede the reliable operation of the magazine.

Figure 2:
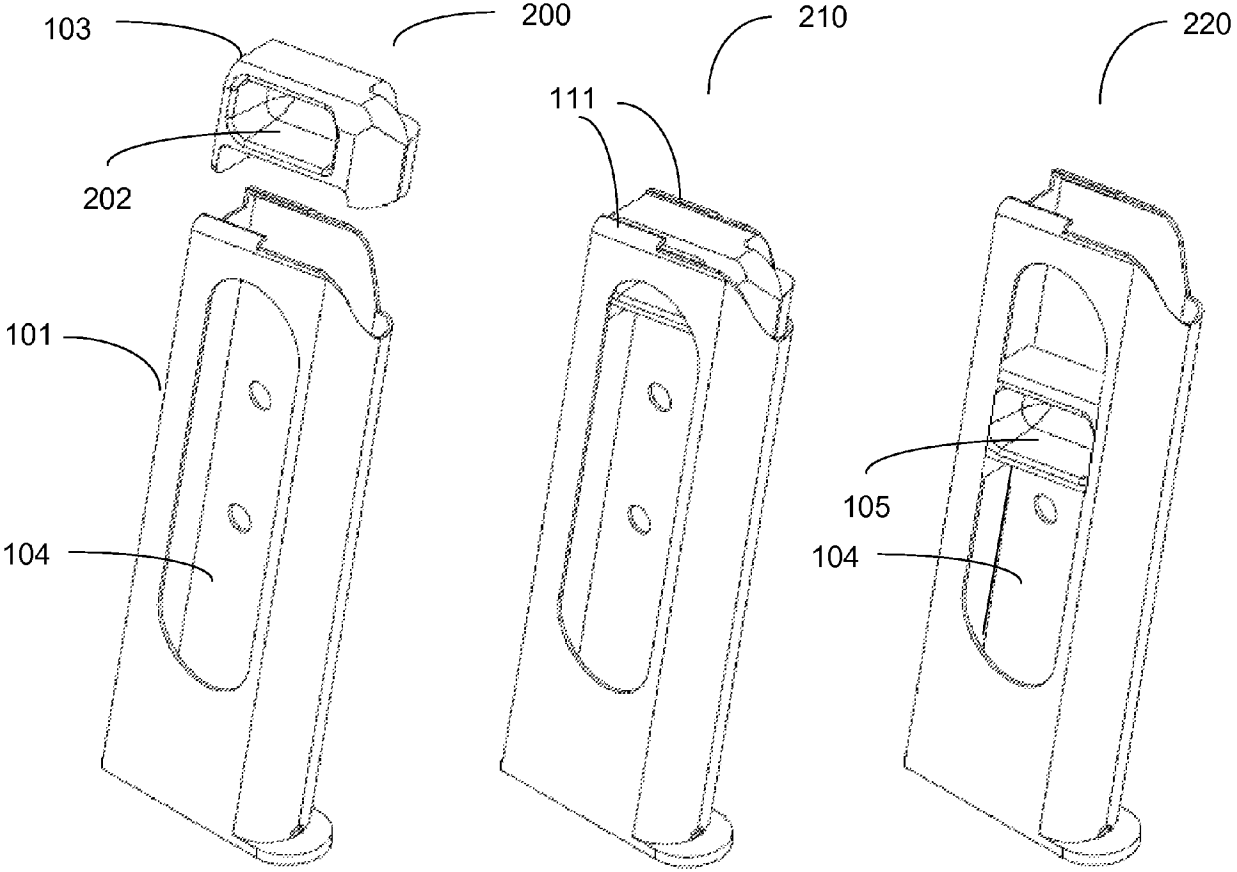
FIG. 2 shows a detailed diagram of a specific embodiment of the invention.

FIG. 2 shows the detail of an exemplary embodiment designed for a specific firearm, such as a Colt 45 caliber automatic pistol. An exploded perspective view 200 includes the magazine body 101 having slot 104 and the associated follower 103 having concave opening 105. The internal spring 102 is omitted for clarity. Assembled view 210 shows the follower 103 being constrained by bent tabs 111 at the top of the magazine body 101. Operating view 220 shows the follower 103 retracted within the magazine body 101 which compresses the internal spring (102, not shown) and allows cartridges to be loaded at the top of the magazine body.

Figure 3:
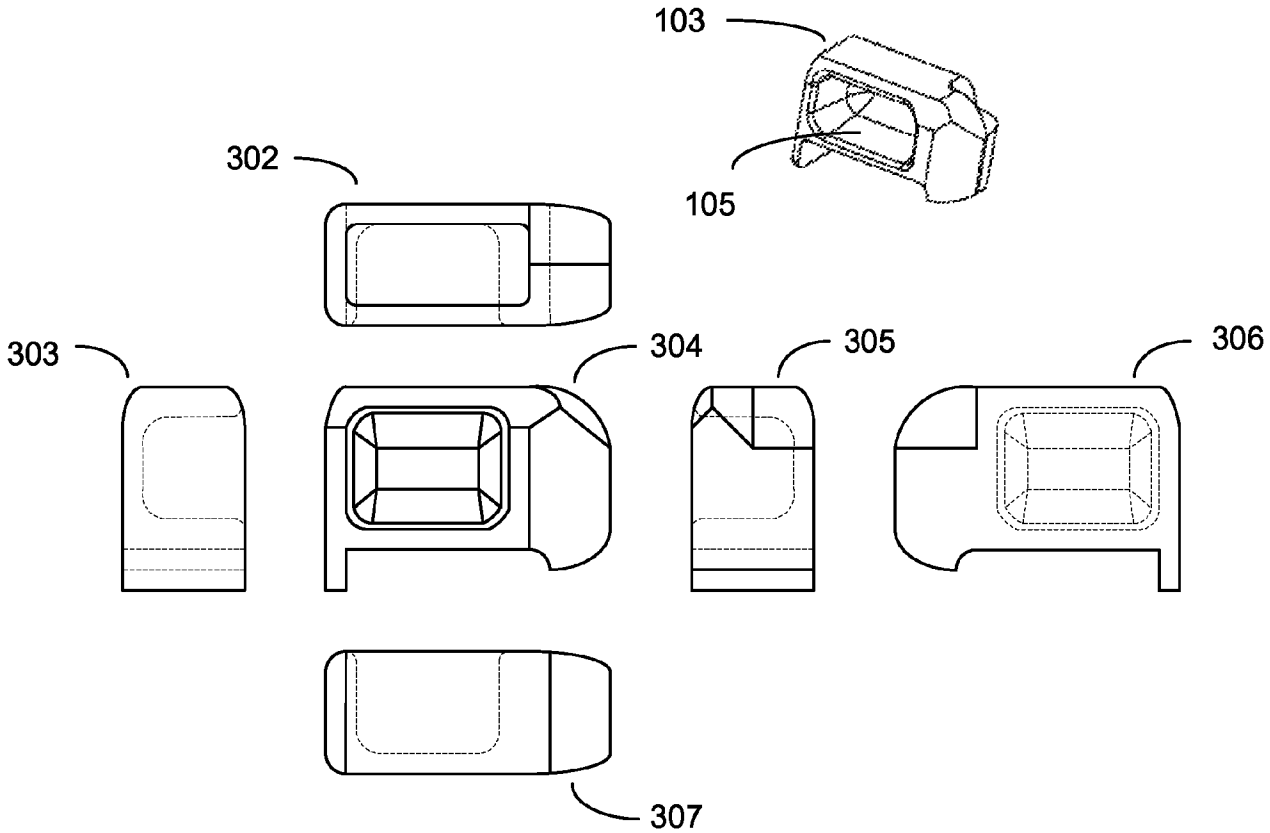
FIG. 3 shows structural details of the follower shown in FIG. 2.

FIG. 3 shows the detailed design of follower 103 for this specific embodiment. As is appreciated by one skilled in the art, the follower design is unique to specific firearms and specific ammunition. In addition to the inset perspective view, the figure shows a top view 302 which engages with the loaded cartridges, rear view 303, right side view 304, frontal view 305, left side view 306 and bottom view 307 that engages with the internal spring 102. Because of its complex shape, the preferred fabrication methods for this follower design include metal casting and injection molded plastic. In an alternative embodiment, the concave opening 105 can extend the entire width of the follower, resulting in a rectangular ring structure that can be used to grasp the follower.

Figure 4:
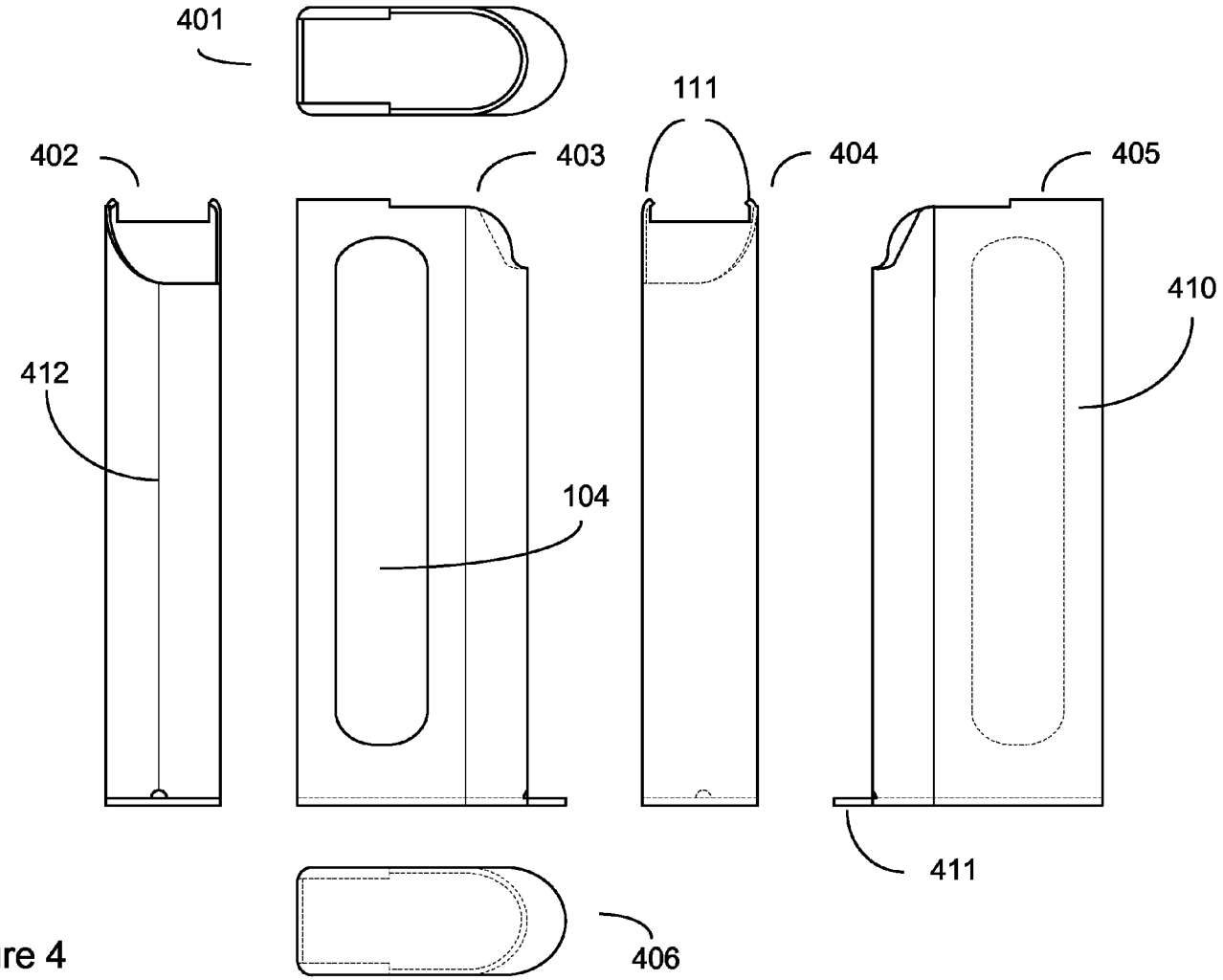
FIG. 4 shows structural details of the magazine body shown in FIG. 2.

FIG. 4 shows the detailed design of magazine body 101 for this specific embodiment. As is appreciated by one skilled in the art, the magazine body design is unique to specific firearms and specific ammunition. The figure shows a top view 401, frontal view 402, right side view 403 including slot 104, rear view 404 including bent tabs 111 which constrain the loaded cartridges and the follower when the magazine is empty, left side view 405 and bottom view 406. In this configuration the preferred fabrication method is stamped and bent metal plate, the magazine body consisting of two pieces: the box 410 which is bent and edges joined by welding at frontal seam 412 and a flat stamped bottom plate 411 that is inserted into and welded to box 410.

As is apparent from the preceding description, the new magazine provides for easy manual loading without the need for external devices or tools, and absent any protruding knobs, handles or cables that require special design of or modification to the firearm in which it is used.

What is claimed is:

1. A magazine for a firearm said magazine comprised of components and said components comprising:

a) a magazine body to be inserted into a firearm and adapted to contain a plurality of cartridges, b) a follower having a top surface and a bottom surface which is upwardly and downwardly movable within the magazine body beneath the cartridges to apply upward pressure on them at its top surface said follower completely encased within the magazine body c) an internal spring compressed between the magazine body and the bottom surface of the follower applying upward pressure on the follower said spring completely encased within the magazine body d) at least one grasping structure fabricated within the follower between its top surface and bottom surface said grasping structure completely encased within the magazine body, e) said magazine body having opposite side walls containing at least one elongated slot located on a side wall adjacent to and aligned with one of the grasping structures fabricated within the follower allowing communications with the grasping structure through the elongated slot said communication done using only components completely encased within the magazine body.

2. The magazine of claim 1 wherein the grasping structure is a concave opening molded into the follower.

3. The magazine of claim 1 wherein the grasping structure is an open ring structure attached between the top and bottom surfaces of the follower.

* * * * *